US006135044A

United States Patent [19]

Nielsen

[11] Patent Number: 6,135,044

[45] Date of Patent: Oct. 24, 2000

[54] TRANSPORT SHIP

[75] Inventor: Jens M. Nielsen, Dragør, Denmark

[73] Assignee: IMA International Maritime Advisers, Copenhagen, Denmark

[21] Appl. No.: 09/203,554

[22] Filed: Dec. 2, 1998

Related U.S. Application Data

[60] Provisional application No. 60/072,989, Jan. 29, 1998.

[51] Int. Cl.[7] ..... B63B 25/08

[52] U.S. Cl. ..... 114/74 R; 114/72

[58] Field of Search ..... 114/72, 73, 74 R, 114/74 A, 78

[56] References Cited

U.S. PATENT DOCUMENTS 5,406,901 4/1995 Ellis ..... 114/72

FOREIGN PATENT DOCUMENTS 4225790 2/1994 Germany .

2081023 6/1997 U.S.S.R. .

1508739 4/1978 United Kingdom .

*Primary Examiner*—Jesus D. Sotelo

*Attorney, Agent, or Firm*—Dykema Gossett PLLC

[57] ABSTRACT

A transport ship (20) adapted for simultaneous transport of a cargo of i) a liquid, particularly oil, and ii) a plurality of containers (32, 32') as well as iii) optionally at least one additional type of goods, the transport ship having: a hull including a sheathing (22), a weather deck (23, 23'), a bottom (18) and a tank (30) for storing and transporting the liquid, as well as a front part (35), a rear part (25) and a central part (29). The ship is a plurality of hold sections (28, 28') defined by the bottom (18) and the weather deck (23, 23'), the hold sections (28, 28') being adapted to store containers (32, 32') and/or the optional additional type of goods, the weather deck (23, 23') is adapted to support containers (32, 32'), the weather deck (23, 23') includes access hatches giving access to the hold sections (28, 28'), and the tank (30) for storing the liquid extends from the area at the bottom (18) of the ship upwards to a height above the weather deck (23, 23').

30 Claims, 2 Drawing Sheets

TRANSPORT SHIP

CROSS-REFERENCE TO RELATED APPLICATION

This application claims the benefit of U.S. Provisional Application No. 60/072,989, filed Jan. 29, 1998.

BACKGROUND OF THE INVENTION

1. Field of the Invention

The present invention relates to a transport ship adapted for simultaneous transport of a cargo consisting of i) a liquid, particularly oil, and ii) a plurality of containers as well as iii) optionally at least one additional type of goods, the transport ship having a hull including a sheathing, a bottom, a weather deck and a tank for storing and transporting the liquid, as well as a front part, a rear part and a central part. In this connection, containers are taken to mean standard containers of the type which is generally used for the transport of goods on board containerships.

2. The Prior Art

The prior art (see e.g., DE-A-2 462 202) includes a few examples of tankers having an oil tank intended for carrying crude oil and allowing simultaneous transport of an additional type of goods during one and the same voyage. The rear part of these ships usually includes a deck superstructure with the navigating bridge of the ship and the means necessary for the propulsion of the ship, including machinery and fuel tanks, while the front part of the ship includes the stem. The central part of the known ship includes the oil tank whose boundary walls may be formed by the sheathing of the ship. The central part of the ship additionally includes a plurality of holds intended to accommodate the additional type of goods. Upwardly, the oil tank is defined by the weather deck of the ship, and this is also the case with the holds.

However, it has previously not been possible to achieve optimum flexibility and capacity with these ships. Thus, the ships are inexpedient, because the volume capacity, i.e., the volume of goods that can be carried, for the additional type of goods is merely achieved at the expense of the crude oil volume capacity. When the ship sails without crude oil, it is only possible to transport an amount of the additional type of goods corresponding to the volume capacity of the holds provided for this type of goods. Neither when sailing with the additional cargo and with oil, nor when sailing with the additional cargo alone, is the ship thus utilized optimally.

An object of the present invention is to provide an improved transport ship which, with a high load capacity, allows transport of various combinations of goods, at least one type of which is liquid, while allowing simultaneous transport of a considerable number of standard containers and optionally an additional type of goods, such as, e.g., general cargo. It must be possible also to transport containers and, e.g., general cargo in relatively large amounts, without this causing any considerable reduction in the volume capacity for the liquid, i.e., the liquid volume that can be carried, relatively to a conventional tanker with corresponding dimensions and a corresponding cost of construction. Hereby, when carrying, e.g., oil, the owner of the ship can obtain considerably higher earnings per voyage than per voyage with the known tankers.

SUMMARY OF THE INVENTION

The above object is achieved according to the invention in that the ship includes a plurality of hold sections defined by the bottom and the weather deck, the hold sections being adapted to store containers and/or the optional additional type of goods, that the weather deck is adapted to support containers, that the weather deck includes the access hatches giving access to said hold sections, and that the tank for storing the liquid extends from the area at the bottom of the ship upwards to a height above the weather deck. It is preferred to provide the total volume capacity of the tank essentially corresponding to the volume capacity of the tank on a conventional tanker having a hull of corresponding dimensions.

When the ship is constructed in this manner, it will also be possible to sail without a cargo of liquid, as the rest of the goods may be stowed relatively low against the keel on one or both sides of the liquid tank in the longitudinal direction of the ship. It is noted that it is hereby possible to maintain a favourable metacentre height for the normally occurring combinations of cargo, as only the draught of the ship will change considerably by changed load conditions. As only a small part of the hull itself surrounds the liquid tank, the risk of leakage of liquid in case of collision is reduced relatively to conventional tankers.

According to a preferred embodiment of the invention, the tank has a total volume capacity of between about 5,000 and 100,000 $m^3$, preferably about 40,000 $m^3$, while the hold sections are adapted to accommodate a total of at least 200, preferably at least about 450 standard containers. A ship with such specifications will typically have dimensions which make it possible to sail through the Panama Canal.

Particularly when the front part of the transport ship includes one of the hold sections, the rear part of the transport ship includes one of the hold sections, and the central part of the transport ship includes the said tank, it is possible to ensure a symmetrical load impact on the ship under all load conditions.

It is moreover preferred that the hold sections have transverse walls which are substantially vertical, and which directly adjoin the tank, optionally with intermediate coffer dams, and that the walls of the hold sections extending in the longitudinal direction of the ship are formed by the sheathing of the hull. This provides optimum utilization of the ship, as the natural walls are utilized for defining the various holds.

It is particularly preferred that the tank is formed of a plurality of independent compartments which may optionally be cylindrical, box-shaped or spherical, thereby providing the same advantages as in conventional tankers. The cylindrical compartments may be arranged with a vertically or horizontally extending longitudinal axis.

According to a particularly preferred embodiment, the tank extends upwards to a height above the weather deck of between 10% and 200%, preferably between 50% and 150%, of the moulded depth of the ship measured to the weather deck. In this case, the moulded depth is measured from the base line of the ship. In particular, the tank may extend upwards to a height above the weather deck of at least 10 meters, preferably at least 15 meters, and/or be constructed so that its volume above the weather deck constitutes at least 20%, preferably between about 40% and 60%, of the total volume of the tank. This results in a suitable volume capacity ratio for the respective parts of the cargo.

To achieve relatively symmetrical load conditions and thereby ensure a favourable stability as regards the trim moment of the ship, it is preferred that the tank extends symmetrically about the midship section and the middle-line plane.

Finally, it is preferred that access hatches are provided to the hold sections substantially in the entire width of the hold sections. The hold sections may hereby be filled and emptied in the same manner as in conventional containerships.

The invention will be explained more fully below with reference to the preferred embodiment shown in the drawing.

DETAILED DESCRIPTION OF THE PREFERRED EMBODIMENT

Figure 1:
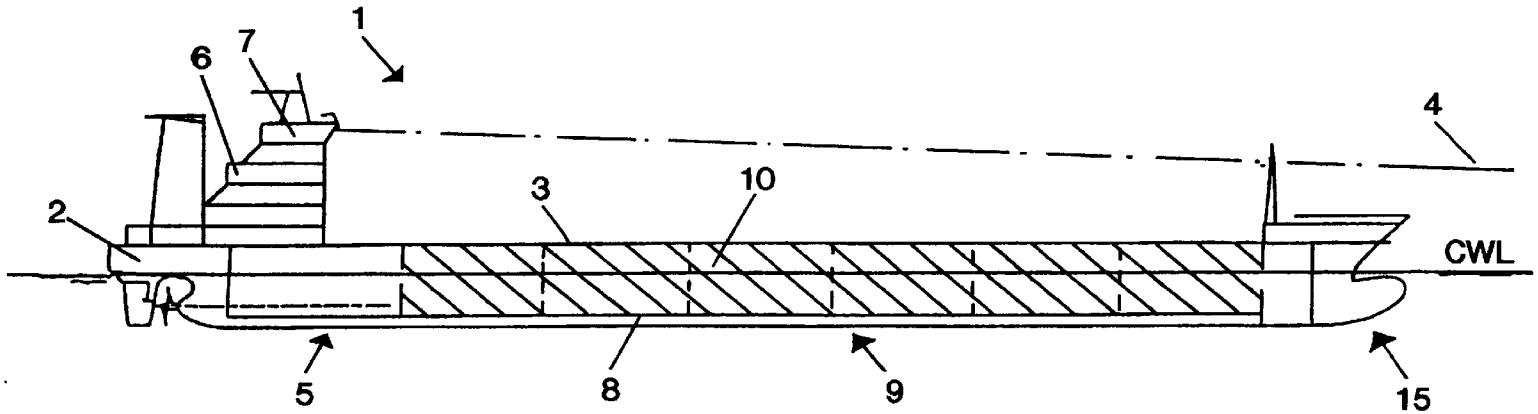
FIG. 1 PRIOR ART
FIG. 1 shows an example of a known type of tanker, seen schematically in a partially vertical longitudinal section.

FIG. 1 shows an example of a conventional tanker 1 having a hull including a sheathing 2 and a weather deck 3 which constitutes the upward closure of the hull. The tanker 1 has a rear part 5 including the necessary machinery for the propulsion of the ship, fuel tanks and a deck superstructure including premises 6 for the crew and a navigating bridge 7. In addition, the ship 1 includes a front part 15 with the stem and bulb of the ship, and a central part 9 with a hold 10. The hold 10 is formed by a tank which is shown in hatched line, and which comprises a plurality of independent compartments whose walls may be formed by the sheathing 2. The tank is defined upwardly by the weather deck 3 of the ship and downwardly by the bottom 8 of the ship. Ships of this type are typically constructed solely with a view to carrying an amount of liquid, primarily oil, as large as possible, and the ships will have no cargo in the tank when returning to the oil store. The tank is arranged to extend over about 80% of the total length of the tanker in the fore-and-aft direction of the ship.

Because of the current safety rules it is not allowed to carry a surface cargo in the form of, e.g., containers above the tank on the weather deck 3 on board conventional tankers, which unduly limits the owner's earnings. If the safety rules allowed such surface cargoes, the possible stacking height of, e.g., containers on the weather deck 3 would be limited in any event when sailing without liquid in the tank, because the metacentre height in this load situation would be very high. Compensation of such stability conditions will generally require mounting of ballast tanks, the result of which is merely that the ship has to sail with a partial, unprofitable load in the form of pumped water. Tankers are thus generally inexpedient, because, if so allowed by the rules, only a relatively limited number of containers can be carried on the weather deck.

Figure 2:
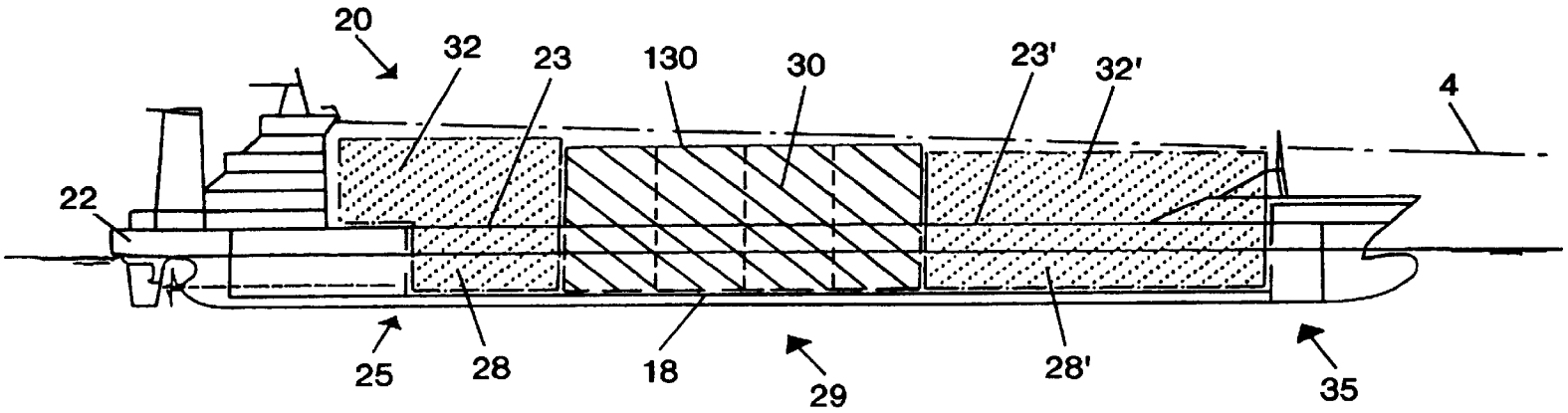
FIG. 2 shows a preferred embodiment of a transport ship according to the invention, seen schematically in a partially vertical longitudinal section.

FIG. 2 shows a vertical longitudinal section through a transport ship 20 according to the invention. The shown transport ship 20, like the conventional tanker, includes a hull with a sheathing 22, a weather deck 23, 23', a bottom 18 and a hold. The hold is divided into three sections, and the rear part 25 of the ship comprises the machinery of the ship as well as a rear hold section 28. The front part 35 of the ship 20 includes the stem of the ship and a front hold section 28'. Both the front and rear hold sections 28, 28' are defined upwardly by a respective part 23, 23' of the weather deck, which is formed with access hatches giving access to the hold sections 28, 28' with a view to vertical lowering of goods, in particular containers. To allow lowering of containers or other goods toward the bottom 18, the hatches are preferably arranged in the entire width of the hold sections 28, 28' like in conventional containerships, and the hatch covers are constructed to support a surface cargo in the form of containers 32, 32' placed on the weather deck 23, 23'. The front part 23' and the rear part 23 of the weather deck are moreover preferably at the same level above the base line of the ship as the weather deck 3 in the conventional tanker 1 (FIG. 1).

In addition, the transport ship 20 includes a central part 29 comprising a tank 30, and the extent of the tank 30 in the fore-and-aft direction of the ship preferably constitutes about 25%–40% of the total length of the ship. The width of the tank 30 may preferably correspond to the width of the ship. The tank 30 is intended to transport liquid goods, such as wine, oil, chemicals or the like, and is defined upwardly by a horizontal tank wall 130, which may optionally include the conventional pipe stubs necessary for the filling and emptying. As shown, the front part 23' and the rear part 23 of the weather deck adjoin the tank 30. The transverse walls of the hold sections 28, 28' closest to the tank 30 are preferably substantially vertical and directly adjoin the tank 30, optionally via intermediate coffer dams.

In the embodiment shown in FIG. 2, the upper, horizontal tank wall 130 is arranged at a height above the weather deck 23' of about 100% of the moulded depth of the ship measured to the weather deck 23' from the base line. Furthermore, the volume of the part of the tank 30 extending above the weather deck 23' corresponds to about 50% of the total volume of the tank 30. A comparison with the volume capacity of the conventional tanker 1 of a corresponding length shown in FIG. 1 will show that selection of a suitable height of the tank wall 130 will generally provide the same volume capacity for liquid in the tank as in the conventional tanker.

FIG. 2 shows a situation where the ship 20 is fully loaded with liquid (indicated in hatched line) in the tank 30 and with a plurality of containers 32, 32' (indicated in dot-hatched line) stacked above each other in the hold sections 28, 28' and on the weather deck 23, 23'. The stacking height of the containers 32, 32' will usually be limited partly owing to the stability of the ship against heeling and partly by international maritime rules, according to which the line of sight 4 from the navigating bridge must reach the surface of the sea at a distance from the stem corresponding to the length of the ship. As the containers may be stowed relatively low against the bottom 18 of the ship, a considerable number of containers can be carried without any danger to the stability of the ship, both without and with a cargo of oil in the tank 30.

Figure 3:
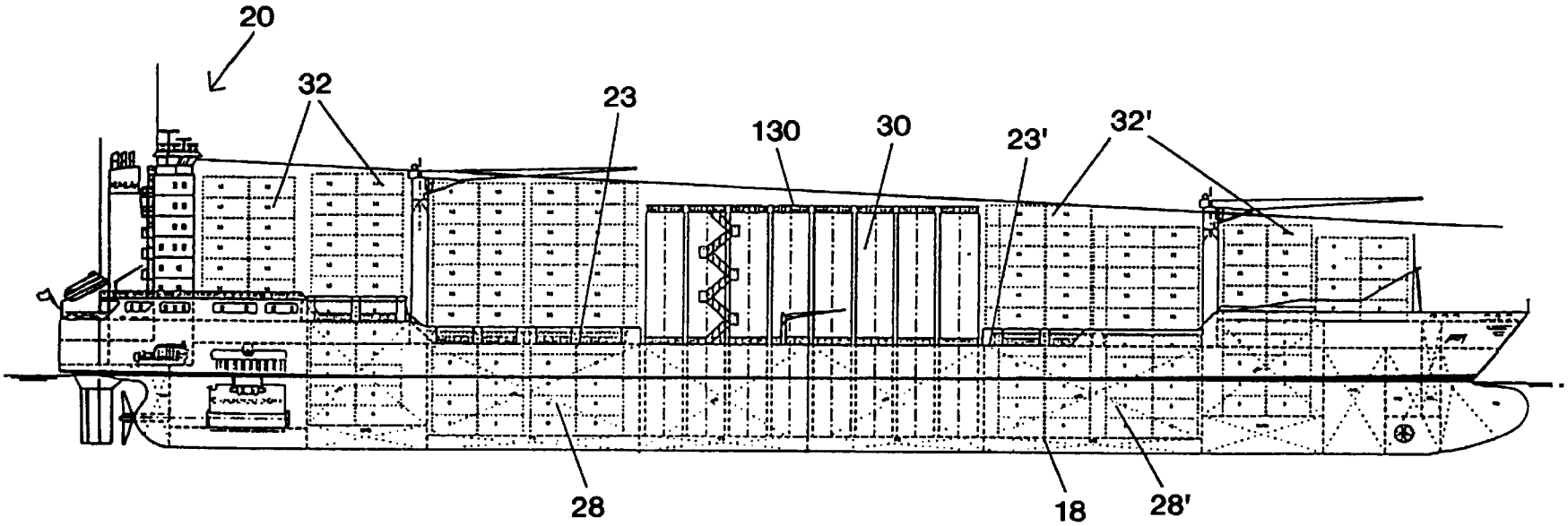
FIG. 3 shows the embodiment of FIG. 2 in more detail, seen from the side and provided with a tank comprising vertical, cylindrical compartments.

FIG. 3 is a lateral more detailed view of the transport ship shown in FIG. 2. The figure shows an example of an expedient stacking of the containers 32, 32' and a concrete construction of the tank 30. As will be seen, the tank 30 may be formed of a plurality of independent cylindrical compartments, which have a vertically extending longitudinal axis, and which extend from the bottom 18 of the ship to the line of sight 4. The compartments may be arranged at a certain mutual distance and may optionally be adapted for the transport of various types of liquid.

Although FIG. 3 shows containers 32, 32' arranged in all hold sections, it is clear that some or all of these hold sections 28, 28' may be filled with another type of goods, e.g., general cargo or particulate goods. Owing to the stability of the ship 20, particularly when sailing without liquid in the tank 30, it will be important to place a cargo, be it general cargo or containers, in the hold sections.

Table 1 below serves to illustrate some of the advantages of the invention. The table compares the capacity of, e.g., a ship (see FIG. 3) according to the invention constructed with a length of 180 meters and a width of about 30 meters, and with a tank 30 having a volume of 20,000 $m^3$ and a height from the weather deck 23' to the upper horizontal tank wall 130 of about 30 meters, with a conventional tanker as shown in FIG. 1 with the same length/width and the same tank capacity. The cost of construction for both ships will typically amount to DKK 220 million (1997). For both vessels, the distance between the base line and the weather deck will be about 14 m.

TABLE 1

| CARGO COMBINATION | THE INVENTION | CONVENTIONAL SHIP |
|---|---|---|
| A | | |
| Oil | 16,000 tons | 16,000 tons |
| Containers | 0 | 0 |
| B | | |
| Oil | 16,000 tons | 16,000 tons |
| Containers | | |
| on deck | about 1000 | 0 |
| in hold | about 500 | |
| C | | |
| Oil | 0 | 0 |
| Containers | | |
| on deck | about 1000 | 0 |
| in hold | about 500 | 0 |

It should be added that the rear weather deck 23 may very well be arranged at a lower level than the front weather deck 23', as the first-mentioned part of the vessel does not have to be shielded against the waves to the same high extent. In this situation, the position of the upper wall 130 of the tank 30 relative to the weather deck may be determined on the basis of the level of the front weather deck 23'.

I claim:

1. A transport ship adapted for simultaneous transport of a cargo consisting of i) a liquid and ii) a plurality of containers, said transport ship having:

a hull comprising a sheathing, a weather deck, a bottom and a tank for storing and transporting said liquid, and a front part, a rear part and a central part, wherein the ship comprises a plurality of hold sections defined by the bottom and the weather deck, said hold sections being adapted to store containers, the weather deck is adapted to support containers, the weather deck comprises access hatches giving access to said hold sections and the tank for storing the liquid extends from an area at the bottom of the ship upwards to a height above the weather deck.

2. A transport ship according to claim 1, wherein the total volume capacity of the tank essentially corresponds to the volume capacity of the tank in a conventional tanker having a hull of corresponding dimensions.

3. A transport ship according to claim 1, wherein the tank has a total volume capacity of between about 5,000 and 100,000 $m^3$ and the hold sections are adapted to accommodate a total of at least about 200 standard containers.

4. A transport ship according to claim 1, wherein the hold sections have transverse walls which are substantially vertical and which directly adjoin the tank, and the walls of the hold sections extending in the longitudinal direction of the ship are formed by sheathing of the hull.

5. A transport ship according to claim 1, wherein the front part of the transport ship comprises one of said hold sections, the rear part of the transport ship comprises one of said hold sections, and the central part of the transport ship comprises said tank.

6. A transport ship according to claim 1, wherein the tank is divided into a plurality of independent compartments.

7. A transport ship according to claim 6, wherein the independent compartments are cylindrical.

8. A transport ship according to claim 1, wherein the tank extends upwards to a height above the weather deck of between 10% and 200% of the moulded depth of the ship measured to the weather deck.

9. A transport ship according to claim 1, wherein the tank extends upwards to a height above the weather deck of at least about 10 meters.

10. A transport ship according to claim 1, wherein the volume of the tank above the weather deck constitutes at least 20% of the total volume of the tank.

11. A transport ship according to claim 1, wherein access hatches to the hold sections are provided substantially in the entire width of the hold sections.

12. A transport ship according to claim 6, wherein the independent compartments are spherical.

13. A transport ship according to claim 1, wherein said cargo consists of at least one additional type of goods, at least one of said hold sections being adapted to store said containers and said additional type of goods.

14. A transport ship according to claim 1, wherein the tank has a total volume capacity of about 40,000 $m^3$, and the hold sections are adapted to accommodate a total of at least about 450 standard containers.

15. A transport ship according to claim 1, wherein the tank extends upwards to a height above the weather deck of between 50% and 150% of the moulded depth of the ship measured to the weather deck.

16. A transport ship according to claim 1, wherein the tank extends upwards to a height above the weather deck of at least about 15 meters.

17. A transport ship according to claim 1, wherein the volume of the tank above the weather deck constitutes between 40% and 60% of the total volume of the tank.

18. A transport ship adapted for simultaneous transport of a cargo consisting of i) a liquid and ii) a plurality of containers as well as iii) at least one additional type of goods, said transport ship having: a hull comprising a sheathing, a weather deck, a bottom and a tank for storing and transporting said liquid, and a front part, a rear part and a central part, wherein the ship comprises a plurality of hold sections defined by the bottom and the weather deck, at least one of said hold sections being adapted to store said additional type of goods, the weather deck is adapted to support containers, the weather deck comprises access hatches giving access to said hold sections, and the tank for storing the liquid extends from the area at the bottom of the ship upwards to a height above the weather deck.

19. A transport ship according to claim 18, wherein the total volume capacity of the tank essentially corresponds to the volume capacity of the tank in a conventional tanker having a hull of corresponding dimensions.

20. A transport ship according to claim 18, wherein the tank has a total volume capacity of between about 5,000 and 100,000 $m^3$, and the hold sections are adapted to accommodate a total of at least about 200 standard containers.

21. A transport ship according to claim 18, wherein the hold sections have transverse walls which are substantially vertical and which directly adjoin the tank, and the walls of the hold sections extending in the longitudinal direction of the ship are formed by the sheathing of the hull.

22. A transport ship according to claim 18, wherein the front part of the transport ship comprises one of said hold sections, the rear part of the transport ship comprises one of said hold sections, and the central part of the transport ship comprises said tank.

23. A transport ship according to claim 18, wherein the tank is divided into a plurality of independent compartments.

24. A transport ship according to claim 23, wherein the independent compartments are one of cylindrical and spherical.

25. A transport ship according to claim 18, wherein the tank extends upwards to a height above the weather deck of between 10% and 200% of the moulded depth of the ship measured to the weather deck.

26. A transport ship according to claim 18, wherein the tank extends upwards to a height above the weather deck of at least about 10 meters.

27. A transport ship according to claim 18, wherein the volume of the tank above the weather deck constitutes at least 20% of the total volume of the tank.

28. A transport ship according to claim 18, wherein access hatches to the hold sections are provided substantially in the entire width of the hold sections.

29. A transport ship according to claim 18, wherein the tank has a total volume capacity of about 40,000 $m^3$, and the hold sections are adapted to accommodate a total of at least about 450 standard containers.

30. A transport ship according to claim 18, wherein the tank extends upwards to a height above the weather deck of between 50% and 150% of the moulded depth of the ship measured to the weather deck.

* * * * *